US005573452A

United States Patent [19]

Liu

[11] Patent Number: 5,573,452

[45] Date of Patent: Nov. 12, 1996

[54] DRILL GRINDER

[76] Inventor: Yu-chieh Liu, 1st Fl., No. 124, Yung Cheng Rd., Taiping Hisang, Taichung Hsien, Taiwan

[21] Appl. No.: 503,709

[22] Filed: Jul. 18, 1995

[51] Int. Cl.[6] ..... B24B 3/26

[52] U.S. Cl. ..... 451/246; 451/376

[58] Field of Search ..... 451/246, 375, 451/376, 23, 13, 48, 239

[56] References Cited

U.S. PATENT DOCUMENTS 3,851,424 12/1974 Kawaragi ..... 451/291

FOREIGN PATENT DOCUMENTS 248276 2/1948 Switzerland ..... 451/376

385746 1/1933 United Kingdom ..... 451/376

*Primary Examiner*—Robert A. Rose

*Attorney, Agent, or Firm*—Schmeiser, Olsen & Watts

[57] ABSTRACT

A drill grinder includes a feed means in which a sleeve, a first cam, a second cam, and a second casing are engaged in sequence, the sleeve having a disk which has two diametrically opposite formed plane portions and two first wheels rotatably engaged thereto for rolling on the first cam which is equipped with two second wheels for rolling on the second cam and the first cam can only longitudinally be moved in the first casing, the second cam having a ratchet wheel disposed thereto, both of the second cam and the ratchet wheel are mounted to a tubular portion of the second casing in which a ring-type gear engaged for a belt connected, the first casing pivotally engaged to a base by a certain angle corresponding to an axis of the first casing, a start means having a fork to actuate the ratchet wheel and an inspecting means having a probe to contact the disk and a grinding wheel means having a grinding wheel which has a longitudinal axis intersecting the axis of the first casing at an angle, such that the sleeve to which a drill is engaged is rotated by the belt and moved according to the configurations of the two cams so as to be ground by the grinding wheel.

2 Claims, 7 Drawing Sheets

DRILL GRINDER

BACKGROUND OF THE INVENTION

1. Field of the Invention

The present invention relates to a drill grinder for sharpening the lip clearance and the side angle of a drill.

2. Related Prior Art

Generally, a drill needs to be sharpened after a period of use and conventionally, the drill is sharpened by hand rather than by machines. However, a lip clearance and a side angle of the drill are required to be accurately ground so as to have a satisfactory performance but it is difficult to get an accuracy of the lip clearance and the side angle when sharpened by hand, also, it takes too much time to sharpen the drill. Conclusively, it is not efficient to sharpen a drill by hand.

The present invention intends to provide a drill grinder by which the drill to be sharpened can be accurately sharpened with ease and the lip clearance and the side angle of the drill can be accurately derived after a complete operation of the drill grinder such that the present invention mitigates and/or obviates the above-mentioned problems.

SUMMARY OF THE INVENTION

The present invention provides a drill grinder which includes a feed means in which a sleeve, a first cam, a second cam, and a second casing are engaged in sequence, the sleeve having a disk which has two diametrically opposite formed plane portions and two first wheels rotatably engaged thereto for rolling on the first cam which is equipped with two second wheels for rolling on the second cam and the first cam can only be moved longitudinally in the first casing.

The second cam has a ratchet wheel disposed thereto, both of the second cam and the ratchet wheel are mounted to a tubular portion of the second casing in which a ring-type gear is engaged for a belt connected thereto, the first casing pivotally engaged to a base by a certain angle corresponding to an axis of the first casing, a start means having a fork to actuate the ratchet wheel and having a probe to contact the disk, a grinding wheel means having a grinding wheel which has a longitudinal axis intersecting the axis of the first casing at an angle, such that the sleeve to which a drill is engaged is rotated by the belt and is moved according to the configurations of the two cams so as to be ground by the grinding wheel.

It is an object of the present invention to provide a drill grinder which has a feed means to actuate the sleeve in accordance with two cams such that the drill engaged to the sleeve can be ground accurately.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
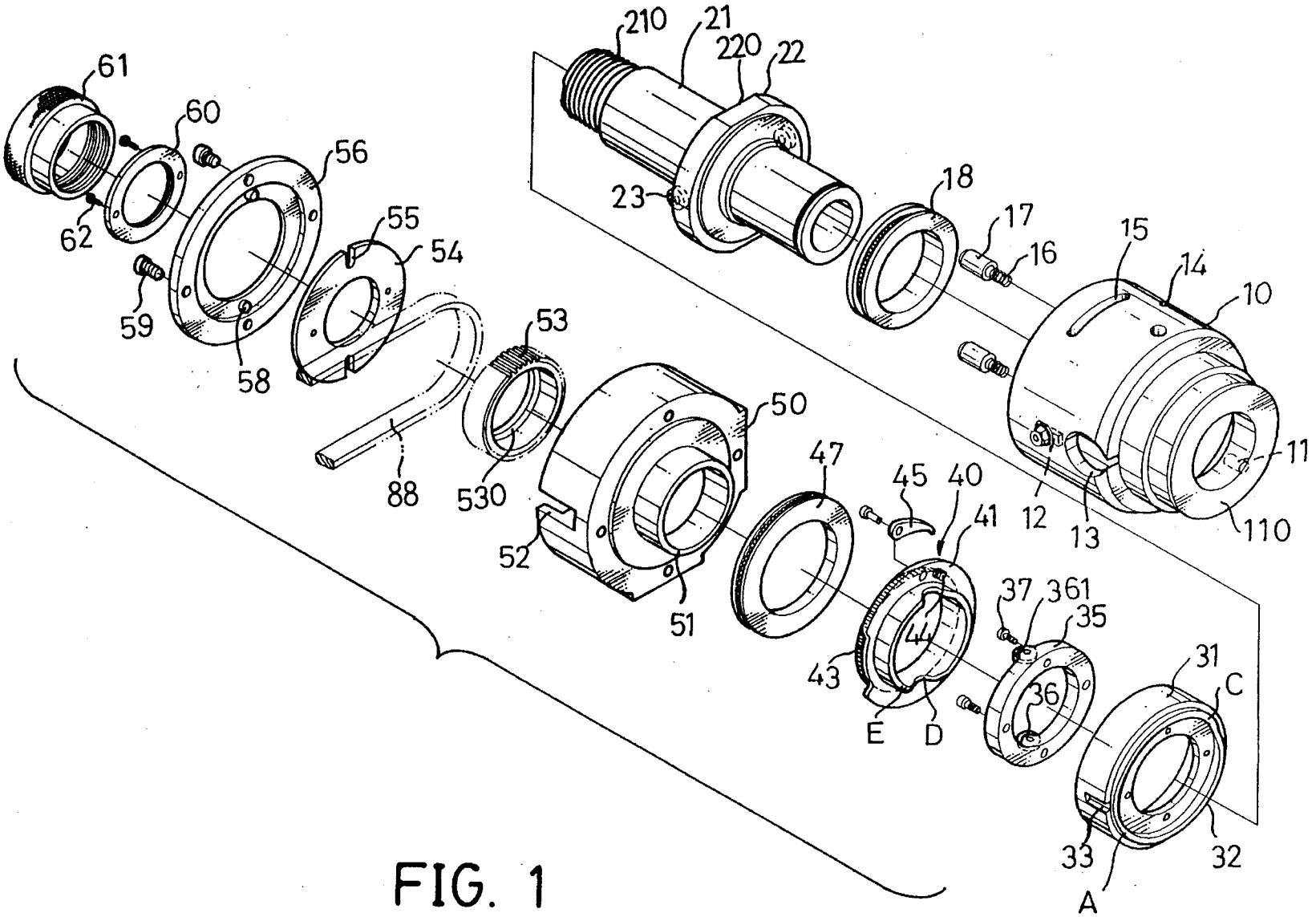
FIG. 1 is an exploded view of a feed means in accordance with the present invention.
Figure 2:
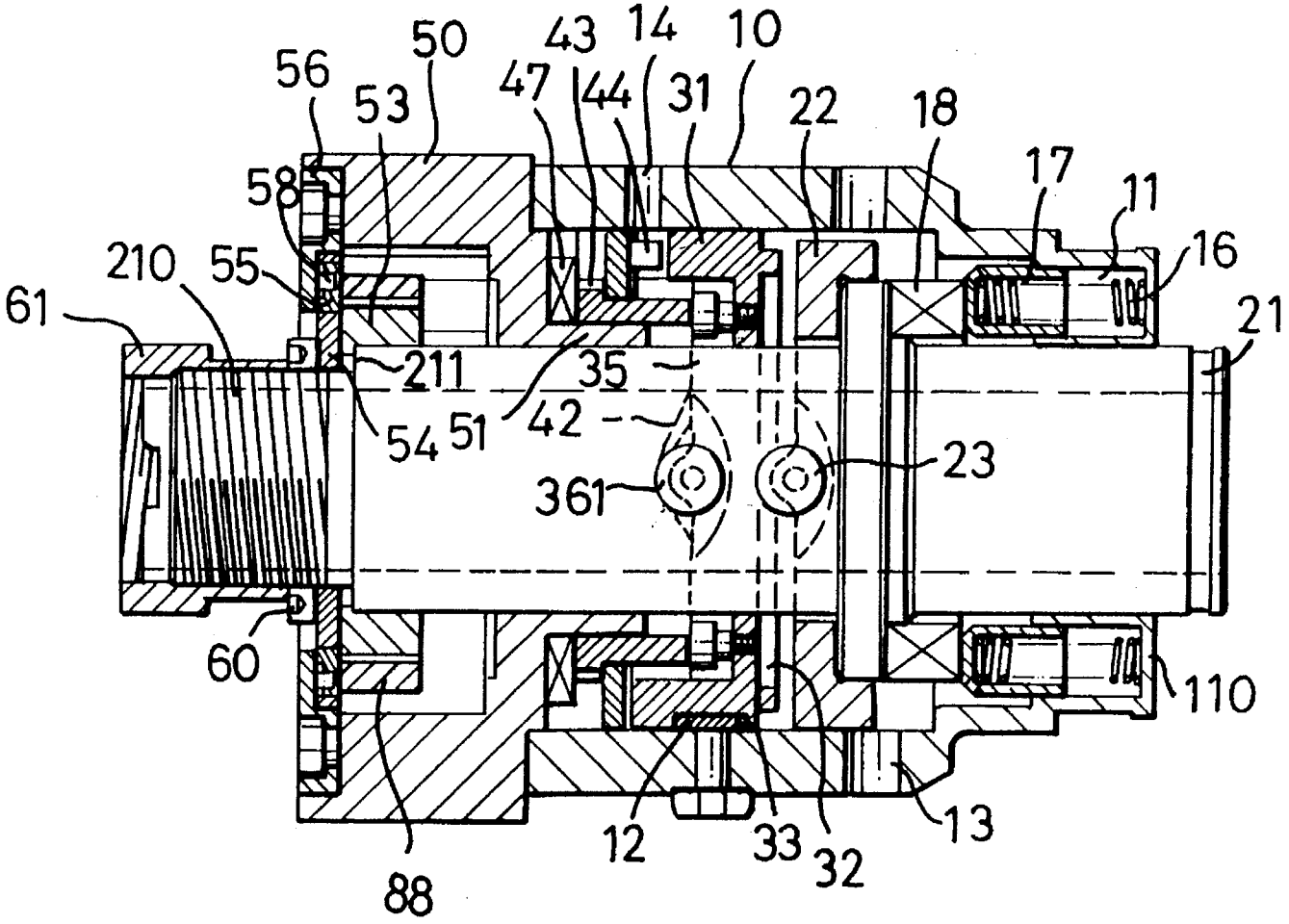
FIG. 2 is a side elevational view, partly in section, of the feed means in accordance with the present invention.
Figure 3:
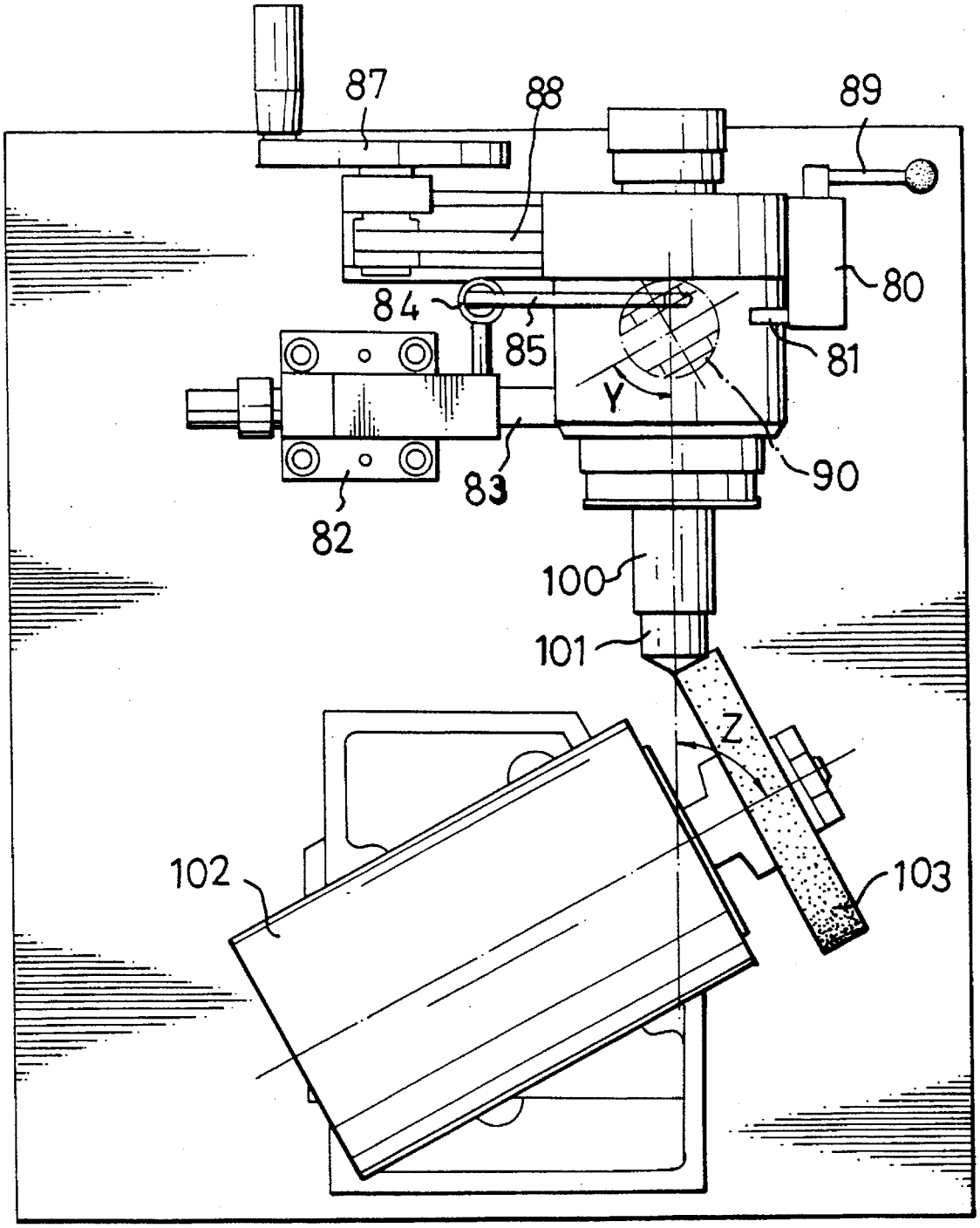
FIG. 3 is a top plane view of the drill grinder in accordance with the present invention.
Figure 4:
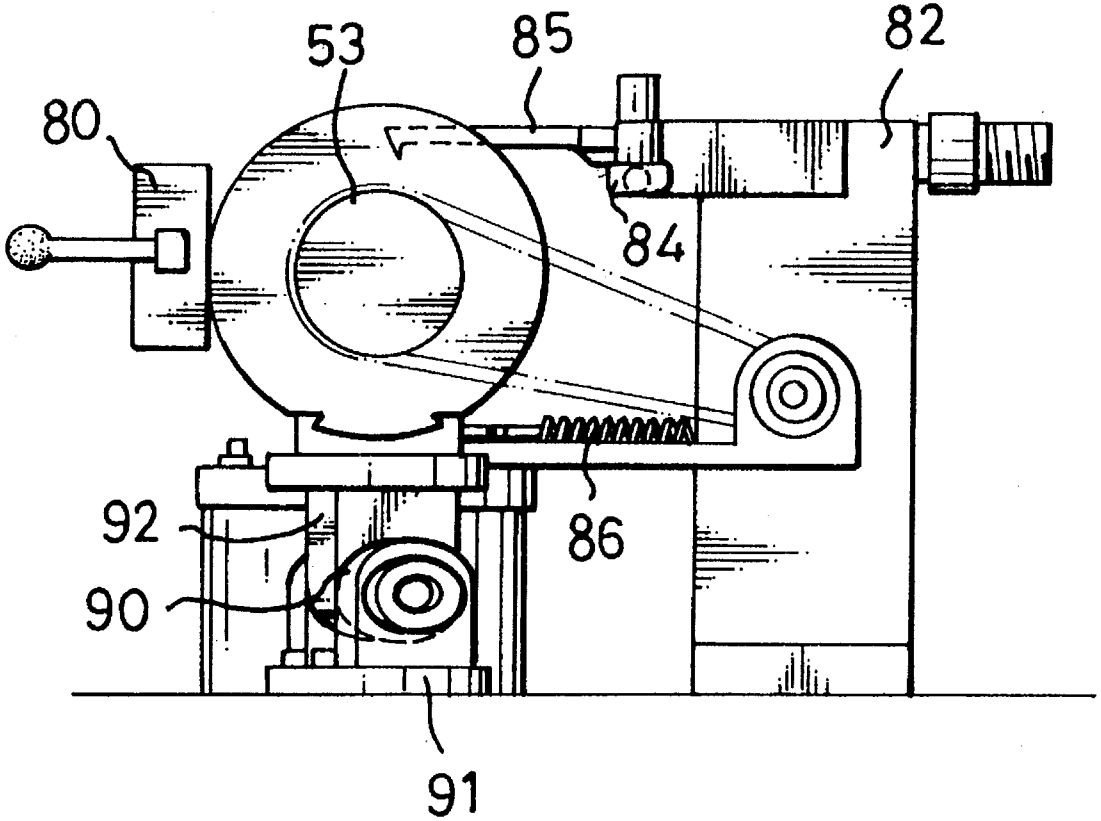
FIG. 4 is side elevational view of the feed means pivotally engaged to a base and an inspecting means having a spring and a second ratchet engaged to the feed means.

Referring to the drawings and initially to FIGS. 1 through 3, a drill grinder in accordance with the present invention generally includes a grinding wheel means including a motor 102 and a grinding wheel 103 which is operated by the motor 102. A feed means includes a first casing 10 which has a first end and a second end, a first slot 14 and a second slot 15 respectively defined in the first casing 10 and not parallel with each other, a hole 13 defined in the first casing 10 and a key 12 diametrically disposed in an inner periphery of the first casing 10, a flange 110 extending inwardly from the second end of the first casing 10 and having at least two first recesses 11 defined in the flange 110 so as to receive a spring 16 and a block 17 therein. The first casing 10 has a dove-tail portion formed to an under side thereof and a pivotal block 92 (FIG. 4) has a dove-tail recess defined in an upper side thereof such that the first casing 10 is engaged to the pivotal block 92 which is pivotally engaged to a base 91 (FIG. 4).

A sleeve 21 has a first end and a second end, the first end thereof having a threaded portion 210 defined in an outer periphery thereof, a shoulder portion 211 formed adjacent to the threaded portion 210, a disk 22 securely mounted to the sleeve 21 and the disk 22 having a plane portion 220 diametrically defined in an outer periphery thereof, two first wheels 23 rotatably disposed to the disk 22 facing to the first end and each of the first wheels 23 having an axis perpendicular to a longitudinal axis of the sleeve 21. The second end of the sleeve 21 is inserted into the first casing 10 with a first anti-thrust bearing 18 mounted thereto which contacts the blocks 17, wherein the position of the disk 22 is corresponding to the hole 13 of the first casing 10, a drill 101 disposed to the second end of the sleeve 21 which extends out of the second end of the first casing 10 and the position of the drill 101 is corresponding to the grinding wheel 103.

A first cam 31 is a ring element and is mounted to the sleeve 21, the first cam 31 having a first curved wall 32 extending longitudinally from a second end of the first cam 31. A ring 35 is engaged to the first cam 31 by threading two bolts 37 therethrough and the ring 35 has two diametrically separated wheel bases 36 so as to rotatably engage a second wheel 361 to each one of the wheel bases 36, each of the second wheels 361 having an axis perpendicular to a longitudinal axis of the first cam 31. A second recess 33 is defined diametrically in an outer periphery of the first cam 31 for receiving the corresponding key 12 of the first casing 10 therein to restrain the first cam 31 to be moved in the second recess 33.

A second cam 40 is a ring element mounted to the sleeve 21 and has a first end and a second end, the second end thereof having a second curved wall 42 extending longitudinally therefrom for the second wheels 361 of the first cam 31 to roll thereon, the second end of the second cam 40 having a ratchet wheel 43 securely engaged thereto and the ratchet wheel 43 corresponding to the second slot 15 of the first casing 10. A flange 41 extends radially from an outer periphery of the second cam 40 and a stud 44 extends from the flange 41, the stud 44 corresponding to the first slot 14 of the first casing 10, a first ratchet 45 pinned to the flange 41 and engaged with the ratchet wheel 43 and a second anti-thrust bearing 47 disposed to a first end of the second cam 40.

A second casing 50 has a first end and a second end, the second end having a tubular portion 51 extending therefrom on which the second anti-thrust bearing 47 and the second cam 40 are mounted, the second casing 50 mounted to the sleeve 21 by extending the sleeve 21 through the tubular portion 51, a ring-type gear 53 received in the second casing 50 which has two cut-aways 52 (only one is shown) defined therein for a belt 88 inserted therethrough and engaged with the ring-type gear 53. The ring-type gear 53 has a flange 530 extending inwardly from a side thereof for engagement with the shoulder portion 211 of the sleeve 21.

A set of fixing rings includes a first ring 54, a second ring 56 and a third ring 60, the first ring 54 having two cavities 55 defined diametrically opposite therein, the second ring 56 having two bosses 58 extending longitudinally therefrom for engagement with the cavities 55 and having four holes defined therein for bolts 59 extending therethrough and engaging-the second ring 56 to the first end of the second casing 50, the third ring 60 and the first ring 54 engaged to the side of the ring-type gear 53 by two bolts 62, an end cap 61 threadedly engaged to the threaded portion 210 of the sleeve 21.

Figure 5:
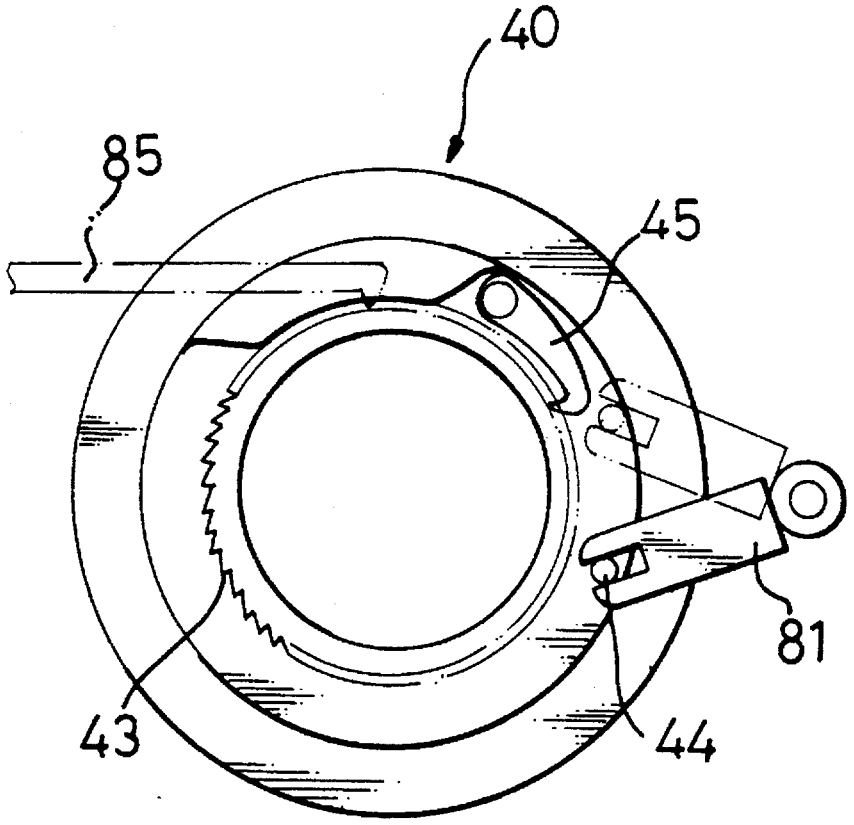
FIG. 5 is an illustrative view showing a start means having a fork engaged to a second cam of the feed means and rotating an angle.
Figure 7:
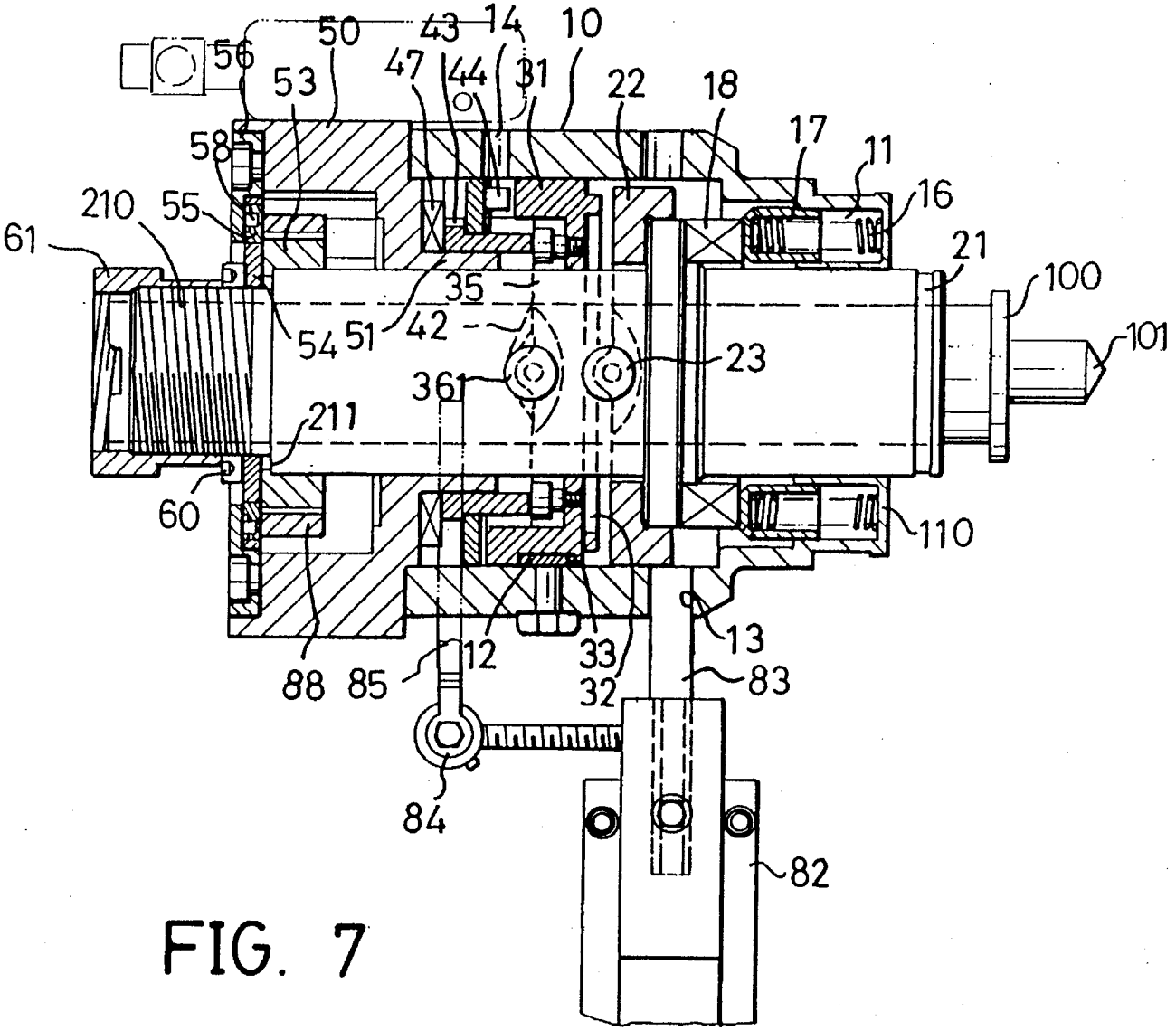
FIG. 7 is a side elevational view, partly in section, of the feed means which is engaged to an inspecting means in accordance with the present invention.

Referring to FIGS. 4, 5 and 7, a base 91 has two lugs 90 extending vertically therefrom, the two lugs 90 being parallel with each other and having a first angle "A" with respect to a longitudinal axis of the sleeve 21, the pivotal block 92 pivotally engaged between the two lugs 90, that is to say, the sleeve 21 can be pivotally rotated about the common axis of the two lugs 90 along the direction having an angle "A" with respect to the axis of the sleeve 21. The central line of the grinding wheel 103 and the longitudinal line of the sleeve 21 have a second angle "B" therebetween which is a complementary angle to the first angle "A" (FIG. 3).

The belt 88 is wrapped around the ring-type gear 53 and a rotating means 87 (see FIG. 3) via the two cut-aways 52, the rotating means 87 is disposed beside the base 91 and the sleeve 21.

An inspecting means 82 is disposed beside the rotating means 87 and has a probe 83 extending therefrom, the probe 83 extending through the hole 13 of the first casing 10 and contacting the disk 22, a spring 86 connected between the inspecting means 82 and the pivotal block 92 engaged to the first casing 10, a second ratchet 85 pivotally engaged to the inspecting means 82 by a universal joint 84 and inserted through the second slot 15 of the first casing 10 and engaged with the ratchet wheel 43.

A start means 80 is disposed beside the first casing 10 and has a fork 81 extending therefrom which inserts through the first slot 14 for engagement to the stud 44 of the second cam 40.

Figure 6:
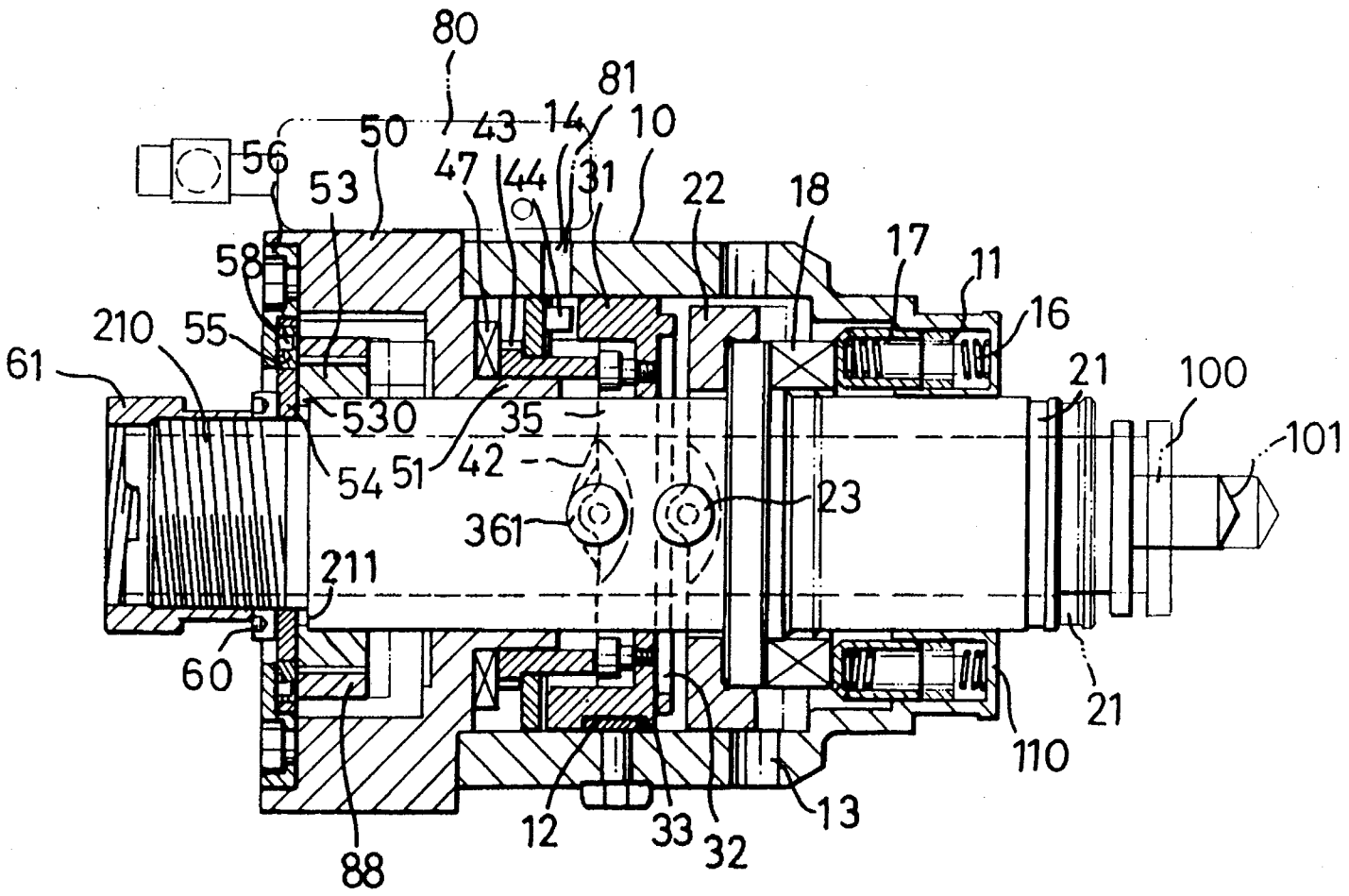
FIG. 6 is a side elevational view, partly in section, of the feed means and which shows the sleeve is actuated to move toward a second end of a first casing.

Further referring to FIG. 6, when operating the grinder, an operator rotates a lever 89 (see FIG. 3) of the start means 80, the ratchet wheel 43 is rotated an angle by the fork 81 and the ratchet 43 is positioned by the first ratchet 45 and the second ratchet 85, this results in a rotating of the second cam 40 such that the second wheels 361 are moved from a lowest point "D" to a point "E" of the second curved wall 42 and the sleeve 21 is therefore moved with the movement of second cam 40 and the drill 101 contacts the grinding wheel 103 by a cutting edge thereof. The belt 88 is then actuated to rotate the ring-type gear 53 which is connected to the end cap 61 which is threadedly engaged to the sleeve 21, the sleeve 21 then rotates and the first wheels 23 roll on the first curved wall 32 of the first cam 31 from the lowest point "A" to a highest point "C", this means that the drill 101 is ground according to the movement of the sleeve 21 which is moved according to the profile of the first curved wall 32. When the sleeve 21 is rotated to an angle that the probe 83 contacts the plane portion 220 which has a shorter distance measured from the center of the sleeve 21 than that from the center to the outer periphery of the disk 22, the whole mechanism including the first casing 10, the second casing and the sleeve 21 is rotated about the common axis of the two lugs 90, by which the side angle is ground. Accordingly, the second cam 40 decides the distance that the sleeve 21 moved toward the grinding wheel 103, the first cam 31 decides the lip clearance of the drill 101 to be ground and the position of the plane portion 220 decides the side angle of the drill 101.

Accordingly, the drill 101 is ground accurately by being disposed to the sleeve 21 and is ground when the sleeve 21 is actuated, this is more accurate than being ground by hand and takes less time compared to that of being ground by hand.

Although the invention has been explained in relation to its preferred embodiment, it is to be understood that many other possible modifications and variations can be made without departing from the spirit and scope of the invention as hereinafter claimed.

I claim:

1. A drill grinder comprising:

a grinding wheel means including a motor and a grinding wheel which is operated by said motor;

a feed means including a first casing which has a first end and a second end, a first slot and a second slot respectively defined in said first casing and not parallel with each other, a hole defined in said first casing and a key diametrically and oppositely disposed in an inner periphery of said first casing, a flange extending inwardly from said second end of said first casing and having at least two first recesses defined in said flange so as to receive a spring and a block therein, said first casing having a pivotal block engaged to an under side thereof;

a sleeve having a first end and a second end, said first end thereof having a threaded portion defined in an outer periphery thereof and a shoulder portion formed adjacent to said threaded portion, a disk securely mounted to said sleeve and said disk having a plane portion diametrically defined in an outer periphery thereof, two first wheels rotatably disposed to said disk facing to said first end and each of said first wheels having an axis perpendicular to a longitudinal axis of said sleeve, said second end of said sleeve inserted into said first casing with a first anti-thrust bearing mounted thereto which contacts said blocks and said disk located corresponding to said hole of said first casing, a drill disposed to said second end of said sleeve which extends out from said second end of said first casing;

a first cam being a ring element mounted to said sleeve and having a first curved wall extending longitudinally from a second end of said first cam and said first cam having two second wheels rotatably disposed to a first end of said first cam, each of said second wheels having an axis perpendicular to an axis of said first cam, a second recess defined diametrically and longitudinally in an outer periphery of said first cam for receiving said corresponding key of said first casing therein;

a second cam being a ring element mounted to said sleeve and having a first end and a second end, said second end thereof having a second curved wall extending longitudinally therefrom for said second wheels of said first cam to roll thereon, said second end of said second cam having a ratchet wheel securely engaged thereto and said ratchet wheel corresponding to said second slot of said first casing, a flange extending radially from said second cam and a stud extending from said flange, said stud corresponding to said first slot of said first casing, a first ratchet pinned to said flange to engage with said ratchet and a second anti-thrust bearing disposed to a first end of said second cam;

a second casing having a first end and a second end, said second end having a tubular portion extending therefrom on which said second anti-thrust bearing and said second cam are mounted, said second casing mounted to said sleeve by extending said sleeve through said tubular portion, said second casing having two cut-aways defined therein, a ring-type gear received in said second casing and said ring-type gear having a flange extending inwardly from a side thereof for engagement with said shoulder portion of said sleeve;

a set of fixing rings including a first ring, a second ring and a third ring, said first ring having two cavities defined diametrically opposite therein, said second ring having two bosses extending longitudinally therefrom for engagement with said cavities and having four holes defined therein for bolts to extend therethrough and engage said second ring to said first end of said second casing, said third ring and said first ring engaged to said side of said ring-type gear by bolts; and an end cap threadedly engaged to said threaded portion of said sleeve;

a base having two lugs extending vertically therefrom, said two lugs being parallel with each other and said two lugs having a first angle with respect to a longitudinal axis of said first casing, a pivotal block of said first casing pivotally engaged between said two lugs;

a belt wrapped around said ring-type gear and a rotating means via said two cut-aways, said rotating means disposed beside said base;

an inspecting means having a probe extending therefrom and said probe extending through said hole of said first casing and contacting said disk, a spring connected between said inspecting means and said pivotal block engaged to said first casing, a second ratchet pivotally engaged to said inspecting means and inserted through the second slot of said first casing and engaged with said ratchet wheel;

a start means disposed beside said first casing, said start means having a fork extending therefrom and said fork inserted through said first slot for engagement to said stud of said second cam.

2. The drill grinder as claimed in claim 1 wherein said grinding wheel has a central line and said central line and said longitudinal line of said first casing has a second angle therebetween which is a complementary angle to said first angle.

* * * * *